US007832156B2

(12) United States Patent
Trotter

(10) Patent No.: US 7,832,156 B2
(45) Date of Patent: Nov. 16, 2010

(54) CONDENSATION INHIBITION SYSTEM FOR STRUCTURAL WATERPROOFING

(76) Inventor: Robert M. Trotter, 2614 Chestnut Dr. North, Atlanta, GA (US) 30360

( * ) Notice: Subject to any disclaimer, the term of this patent is extended or adjusted under 35 U.S.C. 154(b) by 306 days.

(21) Appl. No.: 11/512,673

(22) Filed: Aug. 30, 2006

(65) Prior Publication Data

US 2006/0283113 A1 Dec. 21, 2006

Related U.S. Application Data

(63) Continuation-in-part of application No. 10/666,500, filed on Sep. 19, 2003, now Pat. No. 7,143,558.

(51) Int. Cl.
*E02D 19/00* (2006.01)

(52) U.S. Cl. ..... 52/169.5; 52/302.3

(58) Field of Classification Search ..... 52/169.5, 52/302.1, 302.3, 551, 552
See application file for complete search history.

(56) References Cited

U.S. PATENT DOCUMENTS

| | | | | |
|---|---|---|---|---|
| 2,645,824 | A * | 7/1953 | Titsworth | 52/302.3 |
| 3,654,765 | A * | 4/1972 | Healy et al. | 405/45 |
| 3,754,362 | A * | 8/1973 | Daimler et al. | 52/169.5 |
| 3,850,193 | A * | 11/1974 | Guzzo | 137/362 |
| 3,852,925 | A * | 12/1974 | Gazzo | 52/302.3 |
| 4,245,443 | A * | 1/1981 | Beechen | 52/169.5 |
| 4,333,281 | A * | 6/1982 | Scarfone | 52/169.5 |
| 4,745,716 | A * | 5/1988 | Kuypers | 52/169.5 |
| 4,760,674 | A * | 8/1988 | Brand et al. | 52/302.3 |
| 4,798,034 | A | 1/1989 | Jarnagin et al. | |
| 4,837,991 | A * | 6/1989 | Shaw | 52/98 |
| 4,843,786 | A * | 7/1989 | Walkinshaw et al. | 52/169.5 |
| 5,288,268 | A * | 2/1994 | Kuypers | 454/341 |
| 5,495,696 | A * | 3/1996 | Repka | 52/169.5 |
| 5,501,044 | A * | 3/1996 | Janesky | 52/169.5 |
| 5,577,357 | A * | 11/1996 | Civelli | 52/233 |
| 5,630,299 | A * | 5/1997 | Jackman et al. | 52/169.5 |

(Continued)

FOREIGN PATENT DOCUMENTS

| | | |
|---|---|---|
| JP | 2002317458 | 10/2002 |

(Continued)

OTHER PUBLICATIONS

Weather Resistive Barriers Technology Fact Sheet.*

(Continued)

*Primary Examiner*—Brian E Glessner
*Assistant Examiner*—Adriana Figueroa
(74) *Attorney, Agent, or Firm*—Troutman Sanders LLP; Trenton A. Ward; Robert R. Elliott, Jr.

(57) ABSTRACT

The present invention provides a condensation inhibition system for structural waterproofing. In accordance with one embodiment of the present invention, a waterproofing system is provided within a dwelling having a wall and a foundation. The wall having a first surface for defining an interior of the dwelling and an exterior in communication with graded soil. The waterproofing system further including a waterproofing panel having a front vapor diffusion retarder portion, a back vapor diffusion retarder portion, and an insulator carried between said front portion and said back portion. Additionally, a collection channel is provided for collecting water entering into the dwelling from the exterior.

20 Claims, 5 Drawing Sheets

U.S. PATENT DOCUMENTS

| | | | | |
|---|---|---|---|---|
| 5,771,643 | A * | 6/1998 | Parker | 52/169.5 |
| 5,845,456 | A * | 12/1998 | Read | 52/741.11 |
| 6,230,468 | B1 * | 5/2001 | Klaus | 52/741.11 |
| 6,598,360 | B1 | 7/2003 | Pratt | |
| 6,619,001 | B1 * | 9/2003 | Pratt | 52/169.5 |
| 6,691,472 | B2 * | 2/2004 | Hubert | 52/169.5 |
| 6,725,616 | B1 * | 4/2004 | Pease | 52/309.7 |
| 7,181,888 | B1 * | 2/2007 | Facaros | 52/169.5 |
| 2002/0152696 | A1 * | 10/2002 | Ruiz et al. | 52/169.5 |
| 2005/0198916 | A1 | 9/2005 | Janesky | |

FOREIGN PATENT DOCUMENTS

| | | |
|---|---|---|
| KR | 1019990023522 | 3/1999 |
| KR | 1020050081652 | 8/2005 |

OTHER PUBLICATIONS

International Search Report for PCT Application No. PCT/US2008/057687 dated Jun. 26, 2008.

* cited by examiner

CONDENSATION INHIBITION SYSTEM FOR STRUCTURAL WATERPROOFING

CROSS-REFERENCE TO RELATED APPLICATIONS

This application is a continuation-in-part of U.S. patent application Ser. No. 10/666,500, filed 19 Sep. 2003 now U.S. Pat. No. 7,143,558, and entitled "Drying System for Structural Waterproofing."

BACKGROUND OF THE INVENTION

1. Field of the Invention

The present invention relates generally to relieving and eliminating water problems associated with the exterior and interior of an enclosure's foundation and, more particularly, to an apparatus and method for inhibiting the growth of mold with existing or newly installed structural waterproofing system by insulating a vapor diffusion retarder.

2. Description of the Related Art

The foundations of buildings often experience water problems due to a variety of causes. When such foundations are constructed, the surrounding soil must be removed prior to construction and then replaced after the foundation is completed. As a result, foundations can become damaged as soil settles outside of the foundation. Furthermore, a negative grade sloping toward the foundation is also often formed due to such settling. With the negative grade, the force of gravity causes water to move toward the foundation cracking the foundation and eventually entering into the building. This is especially true of basements and crawl spaces. When water enters a dwelling, many problems arise, both to the physical structure of the dwelling and to the air.

It is known in the art to install structural waterproofing systems to drain water from basements and crawl spaces. While certain waterproofing systems involve systems outside of the homes, many typical waterproofing systems include some method of draining the water from inside the building to the outside. U.S. Pat. No. 4,798,034 discloses a basement draining channel that extends around the periphery of a basement floor, next to the wall, for draining away collected water. The channel includes a plurality of drain entrance holes leading to drain tubes. When water enters the basement walls, it is directed to a preformed channel and directed toward the entrance holes due to gravity. The water is channeled via gravity to a drain connector pipe to a sump pump.

A problem may exist with current waterproofing systems which utilize such devices. With these devices collecting water and in contact with the walls of the basement, the temperature of the exposed surfaces of the devices are cooled below the temperature of the basement or crawl space due to the water being collected. Consequently, water condensation may occur within the room along the face of the interior panel as the moisture vapor within the room, at the temperature of the room, contacts the colder surface. Such condensation may lead to the development of mold.

Dampness and associated mold from such evaporation causes damage to buildings, ruins possessions, produces foul odors, and even presents potential health problems. When excessive moisture or water accumulates indoors, growing molds produce allergens, irritants, and potentially toxic substances. Although mold growth can be treated, it cannot be eliminated as long as a moisture problem exists. Thus, there is a need in the art for a waterproofing system that inhibits the growth of mold.

Additionally, other deficiencies with certain waterproofing system exists. Some interior panels may not be of sufficient size to collect all of the water entering into the basement, or they may be unsightly. Accordingly, there is a need for improved interior waterproofing panels.

SUMMARY OF THE INVENTION

The present invention provides a condensation inhibition system for structural waterproofing. In accordance with one embodiment of the present invention, a waterproofing system is provided within a dwelling having a wall and a foundation. The wall having a first surface for defining an interior of the dwelling and an exterior in communication with graded soil. The waterproofing system further including a waterproofing panel having a front vapor diffusion retarder portion, a back vapor diffusion retarder portion, and an insulator carried between said front portion and said back portion. Additionally, a collection channel is provided for collecting water entering into the dwelling from the exterior.

DETAILED DESCRIPTION OF THE PREFERRED EMBODIMENTS

The invention is an insulated waterproofing system. The insulated waterproofing system is preferably a system installed in the interior of a basement or crawlspace. The insulated waterproofing system maintains the face of the waterproofing panel at substantially equal to the temperature of the interior air to inhibit the condensation of moisture from inside the dwelling on the face of the waterproofing panel.

Figure 1:
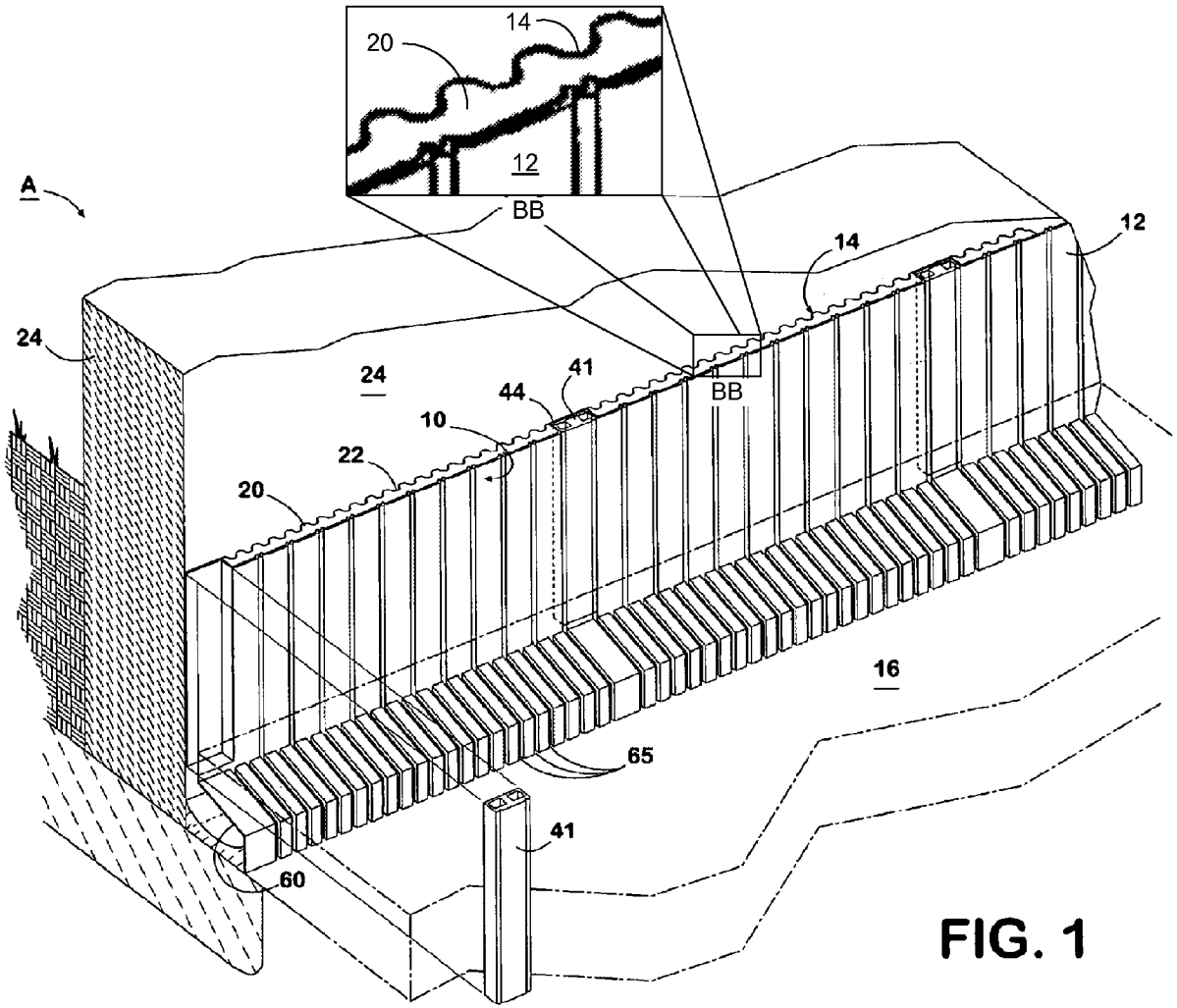
FIG. 1 is a perspective view of a preferred embodiment of present invention.

Referring now in detail to the drawing figures, wherein like reference numerals represent like parts, FIG. 1 illustrates a perspective view of a preferred embodiment of the present invention. The waterproofing system A comprises a waterproofing panel 10 having a front vapor diffusion retarder portion 12 and a back vapor diffusion retarder portion 14. The front vapor diffusion retarder portion 12 is intended to be in communication with the interior of a dwelling 16. The back vapor diffusion retarder portion 14 is intended to be in communication with the foundation or wall of the dwelling. As shown in FIG. 1, and more clearly in detailed view BB, an insulating material 20 may be contained between the front portion 12 and the back portion 14 of the waterproofing panel 10. While the preferred embodiment is shown as a panel 10, in its broadest sense, a single sheet of rigid insulation may be utilized. The face of the rigid insulation would be exposed to the interior of the dwelling forming a vapor diffusion retarder, while the rearwardly extending portion of the insulation would constitute the insulating material and the back retardant portion. Those of skill in the art will appreciate that many insulation materials exhibit vapor diffusion retardant properties and thus could serve as both the insulation and provide the diffusion retarder surfaces.

Figure 2:
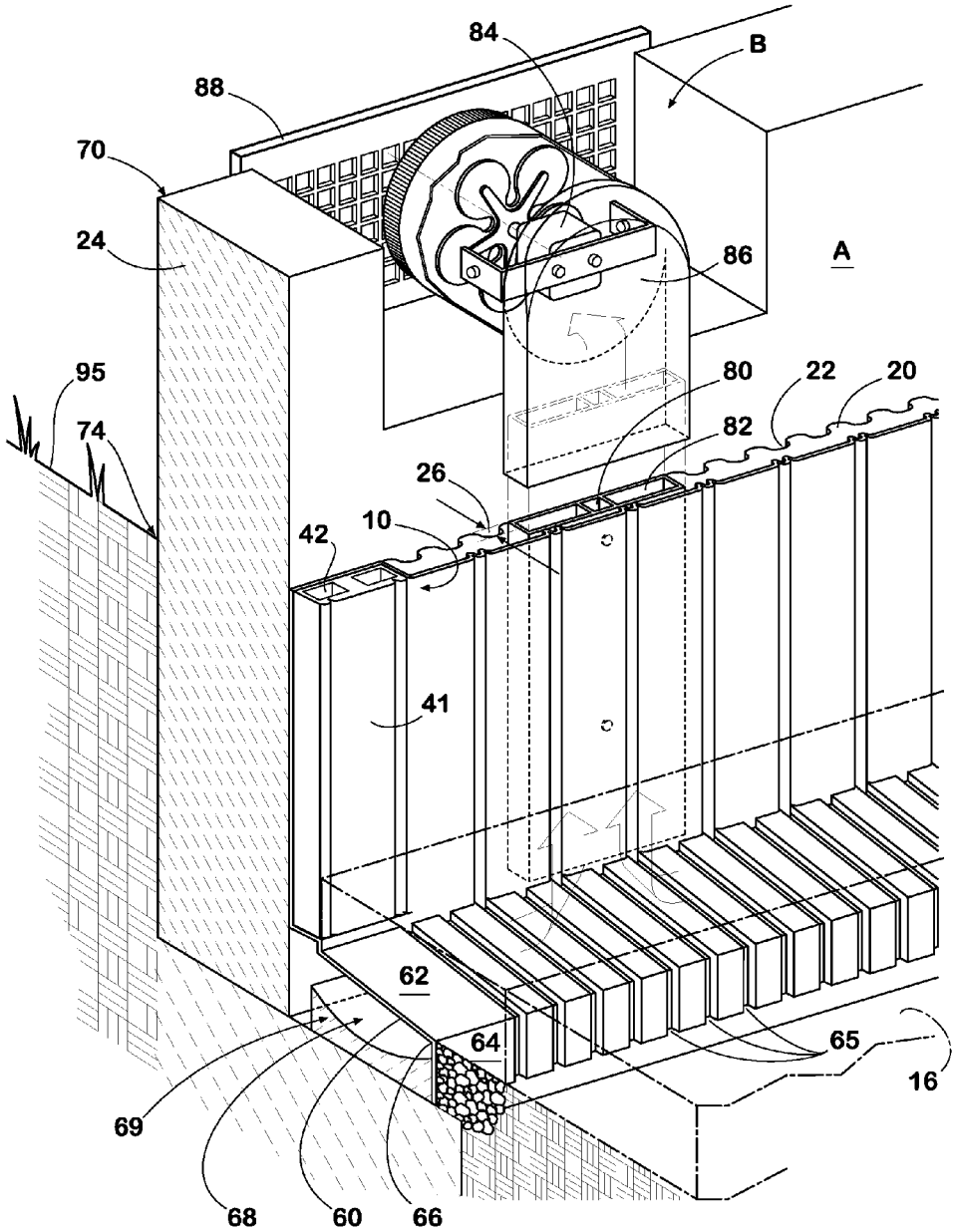
FIG. 2 is a perspective view of a preferred embodiment of the present invention.

As shown in FIG. 2, in the preferred embodiment, waterproofing panel 10 has certain channels 22 which are offset from the wall 24 of the dwelling defining offset spaces 26. A non-limiting example, of one these offset spaces 26 is shown in FIG. 3B. As shown in FIG. 3B, the offset space 26A defines a separation between the wall 24 and the waterproofing panel 10. By being offset, water entering into the dwelling may be channeled through the channels 22 defined by the offset spaces 26 into a collection channel 60. An additional feature of the insulating material is that the back portion 14 of the waterproofing panel 10 is not in communication via an air space with the wall of the dwelling. Nor are portions of the back portion 14 in contact with any water entering into the basement. This removal of contact in addition to having insulation directly in contact with the front portion 12 enables the front portion 12 of the waterproofing panel 10 to be relatively at the same temperature as the air temperature of the inside of the dwelling. Consequently, since there is no temperature differential, moisture contained within the interior air will not condensate on the front portion 12 of the waterproofing panel 10. This prevention will inhibit the growth of mold. Furthermore the undulated nature of the waterproofing panel 10 forms air channels enabling air to circulate and whisk away any moisture on the face of the basement wall.

As seen in FIG. 1, in the preferred embodiment, a single waterproofing panel 10 is utilized to incorporate all of the above described features. Waterproofing panel 10 includes a front vapor diffusion retarder portion 12 and a back vapor diffusion retarder portion 14 that are preferably made from a polymeric material which may have additional additives for strength, color, or other desired characteristics. The front portion 12 and the back portion 14 can be comprised of materials exhibiting a wide range of vapor permeance values or "perm" ratings. Those of skill in the art will appreciate that the perm ratings of the materials used can be altered according the climate and other parameters of a particular installation. For example, and not limitation, in a preferred embodiment both the front portion 12 and the back portion 14 are comprised of a polyethelene material with a perm rating of less than 0.05, and preferably 0.03. In an alternative embodiment, an installation in a more mild climate may allow for the use of painted drywall, with a perm rating of around 2-3, as the front portion 12 and back portion 14 of the waterproofing panel 10. Many different materials of varying perm ratings can be used to provide the surfaces of the waterproofing panel 10 in different embodiments, such as asphalt-coated paper backing on insulation (perm rating ~0.40), plywood with exterior glue (perm rating ~0.70), aluminum foil (perm rating ~0.05), and vapor barrier paint (perm rating ~0.45).

Waterproofing panel 10 also includes an insulating material 20 which is integrally in contact with the back portion 14 and the front portion 12. The insulating material 20 may be a rigid fiberglass, styrofoam, or many other suitable materials that provide insulating benefits to the face of the panel. The depth or "R" factor of the insulating material may depend on the location of the waterproofing system and the normal room temperature of the basement. For instance, in the southeast, basement temperatures typically do not drop below fifty-five degrees Fahrenheit, accordingly, the "R" factor of the insulating material may only need to be R3. However, in other regions, the temperature drop may be more severe requiring more insulating "R" value.

As seen in FIG. 1, the back vapor diffusion retarder portion 14 has an undulating profile creating channels 22 within profile of the back vapor diffusion retarder portion 14. As previously mentioned, these channels may direct water into a water collection channel. Thus, water entering the dwelling through the wall 24 can flow down through the channels 22 to the collection channel 60 to be extracted from the dwelling. Also, by having an undulating profile, only a limited portion of the material is in direct contact with the interior wall of the basement thereby further inhibiting any temperature drop on the face of the panel caused by the coolness of the interior wall.

In some embodiments the collection channel 60 is simply a trough located below the waterproofing panel 10. In other embodiments, the collection channel 60 is a separate structure from the waterproofing panel 10. Further still, alternative embodiments provide a unitary piece in which a collection channel 60 may be integrally molded as an extension of at least a portion of the waterproofing panel 10. In an exemplary embodiment, both the front vapor diffusion retarder portion 12 and the insulating material 20 extend within the collection channel. Furthermore, ribs 65 may be defined within the polymeric material to provide strength for the collection channel 60. Also, these ribs may be extended along the length of the waterproofing panel 10 for providing a strong rigid panel. Many basements are unfinished, and consequently, by installing for panel 10, a surface maybe provided for attaching finishing material. For instance, furring strip 41 is utilized for attaching the panel 10 to the basement wall. Panel 10 includes transitional areas 44 wherein adjacent panels 10 may overlap and be attached together with the wall via the furring strip 41. The transitional areas 44 are of a sufficient width and depth to encircle the furring strip so that a planar surface is provided by the attached panels. This planar surface provides for a smooth surface area for attaching finishing materials such as paneling and the like onto the panels 10. Furring strip 41 provides a surface area for receiving any fasteners, ie. nail or screw which is utilized for attaching the finishing material in a mounted position along the basement wall. Furring strip 41 can also provide conduits 42 to accommodate wiring and other materials.

Figure 3A:
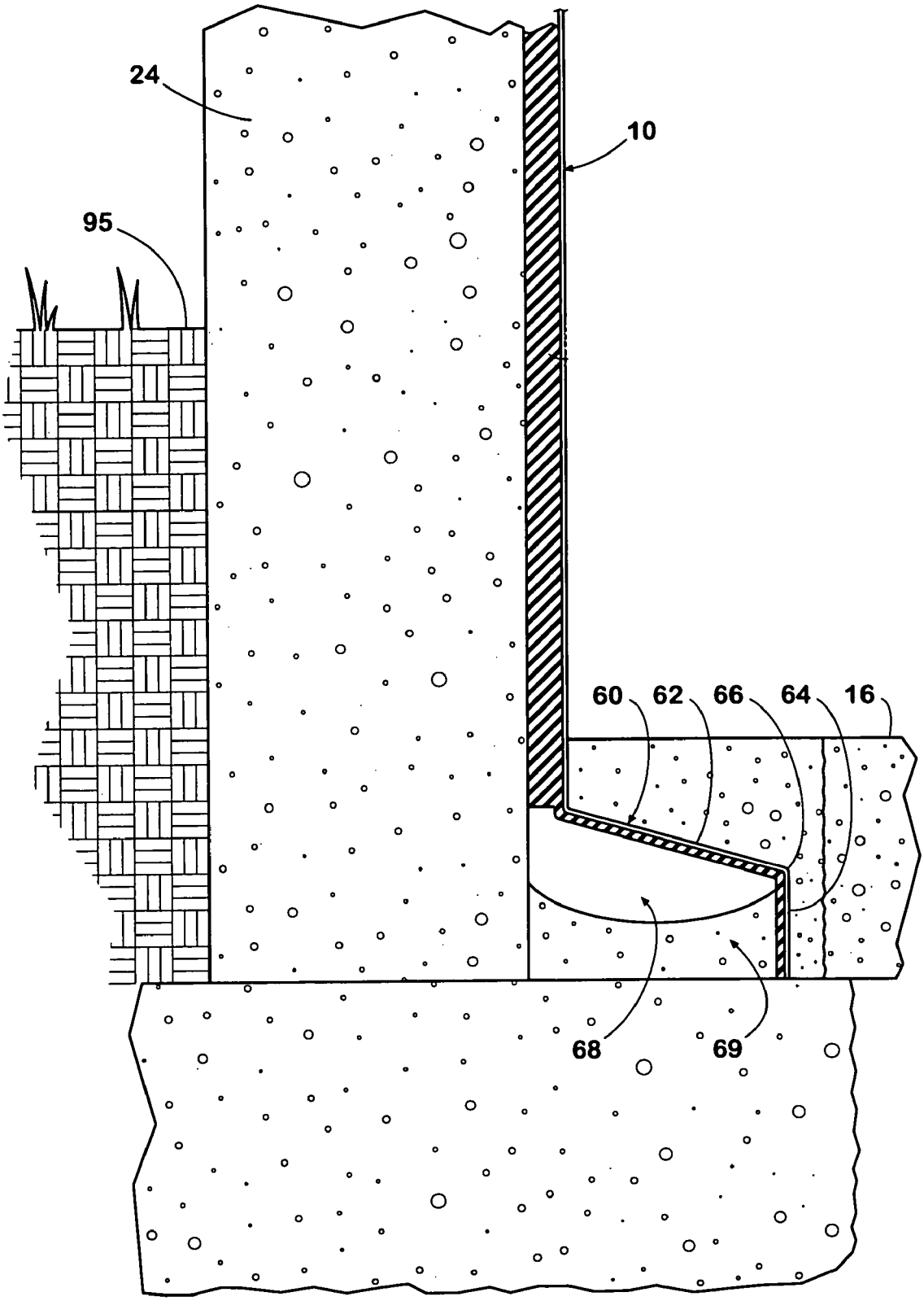
FIG. 3A is a cross-sectional view of a waterproofing panel according to a preferred embodiment of the present invention.
Figure 3B:
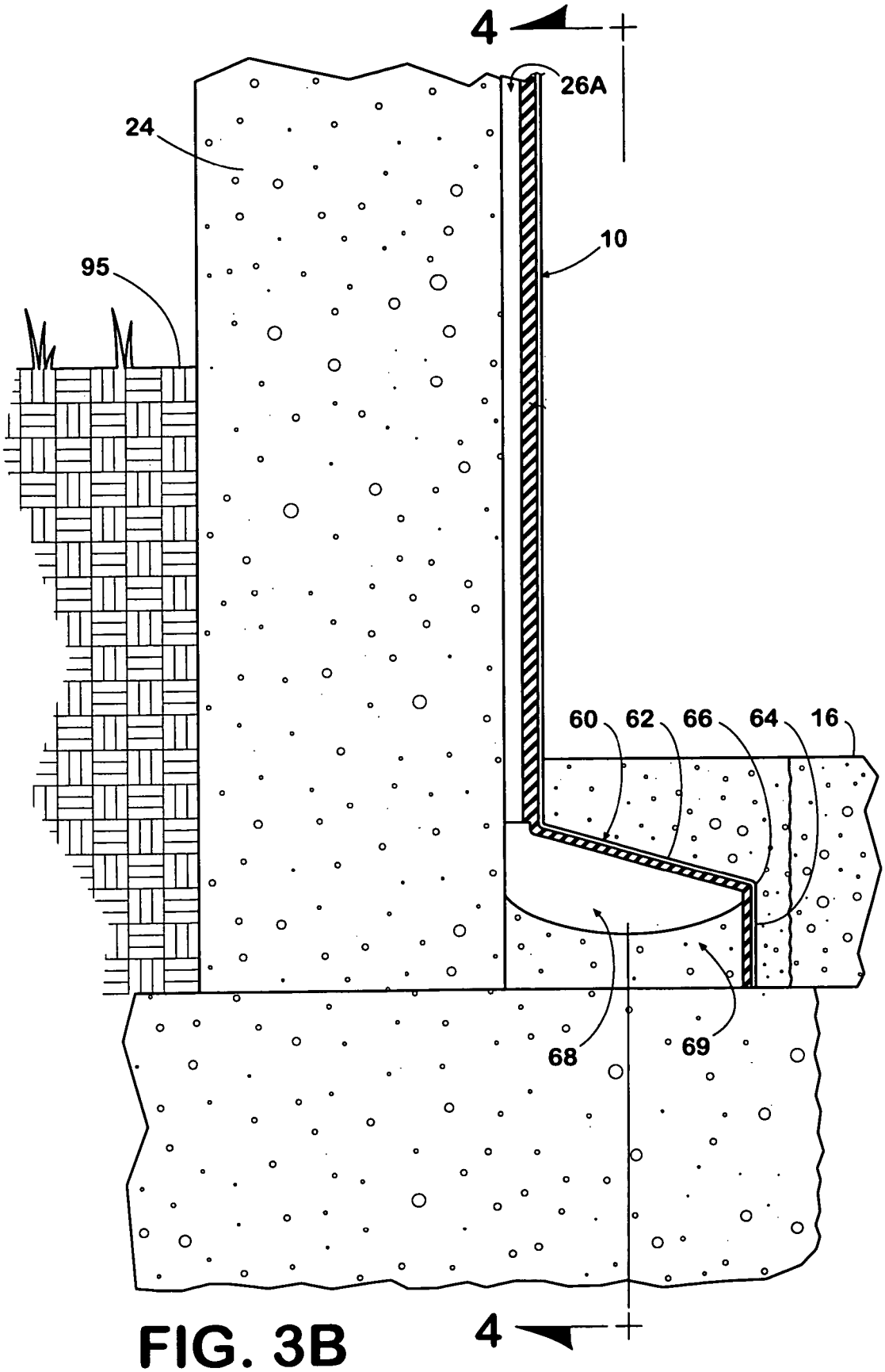
FIG. 3B is a second cross-sectional view of a waterproofing panel according to a preferred embodiment of the present invention.

As shown in FIGS. 3A and 3B, in the preferred embodiment, waterproofing panel 10 extends up along the basement wall to a height at least above the grade 95 of the external ground. In this manner, panel 10 is in a position to collect any groundwater which may enter into the dwelling and also ensures that the face of waterproofing panel 10 may be completely insulated from any cool water entering into the basement. Additionally as shown in FIG. 2, by extending up above ground, the undulated channels 22 an effectively remove water from any portion of the basement wall which would possibly incur moisture due to the temperature difference created in the interior surface of the basement wall from the external ground water.

As shown in FIGS. 1 and 2, collection channel 60 is designed to be installed below the floor of the basement. As show in FIG. 2, the waterproofing system A typically involves breaking up a portion of the basement floor such that the waterproofing system A may be installed in fluid communication with the foundation of the dwelling. The foundation of the dwelling supports the dwelling wall 24. Frequently, the interface 74 between the earthen surrounding 70 and the wall 24 is where the water seeps into the basement. Consequently, the waterproofing system provides for a channel which is designed to remove water from the foundation. As mentioned in the parent application, the removal of water from the foundation is critical to provide for stability of the dwelling.

Accordingly, collection channel 60 is ribbed to provide for structural support. Collection channel 60 includes a profile which in combination with the wall 24 and foundation provides for a drainage conduit 68. Accordingly, in the preferred embodiment, collection channel 60 includes a top collection portion 62, and a side collection portion 64. It may also include an ending portion 66.

As shown in FIG. 2, a waterproof drying system B may be incorporated. The waterproof drying system B includes a conduit 80 which extends down the back portion of the waterproofing panel 10 and fits within the undulating profile of the insulating material. The conduit 80 includes an opening 82 which is in fluid communication with the drainage conduit 68. A blower 84 is located at an opposite end of the conduit 80 for drawing moisture from the drainage conduit 68 through the conduit 80 and passing the moisture outside of the dwelling. A blower shroud 86 is utilized for connecting the blower 84 with the conduit. The blower shroud 86 provides a seal for interfacing with the blower 84 to ensure that moisture does not leak back into the interior of the room. Fasteners may be utilized for attaching conduit 80 with waterproofing panel 10. In the preferred embodiment, conduit 80 is made from rigid polymer material stronger than panel 10. Accordingly, when attached, conduit 80 provides additional strength to panel 10.

An additional feature of the undulating back portion 14 is that channels 22 are formed along the dwelling wall 24. Accordingly, as air is drawn by blower 84, air is drawn along the interior of the basement wall and any additional moisture is carried away from the interior wall. By removing the moisture from the interior wall and from the collection channel 60, an environment for the growth of mold is removed.

Figure 4:
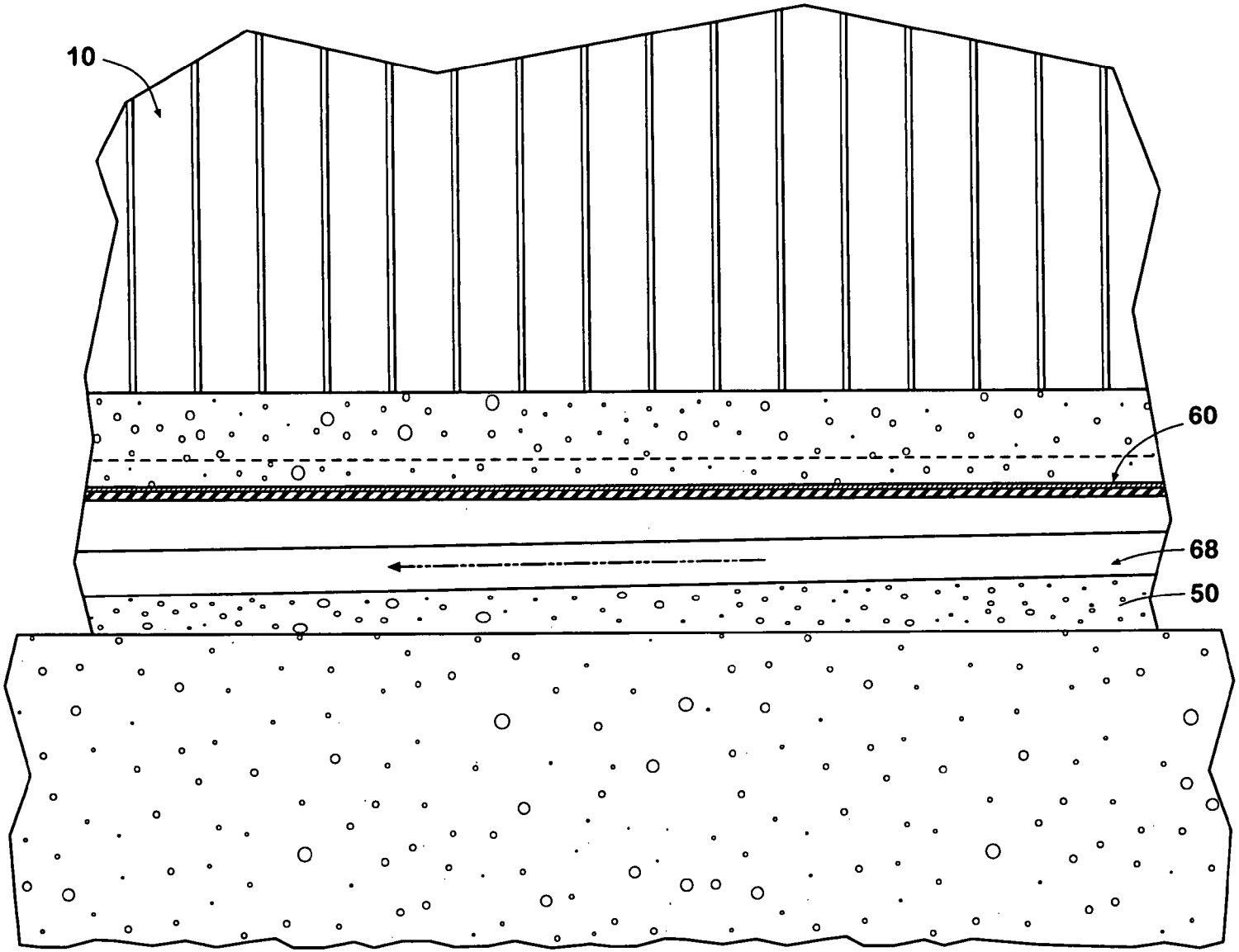
FIG. 4 is a view taken along line 4-4 of FIG. 3 illustrating a crown channel having a downwardly sloping grade for carrying water way from the interior of the waterproofing system according to one embodiment of the present invention.

As shown in FIG. 4, in operation, waterproofing panel 10 with collection channel 60 may be integrated with additional panels along the entire interior of the room such that they form waterproofing system A within a dwelling such as a basement. The typical basement has four walls and a subfloor 50. Collection channel 60 is built into an existing subfloor. Collection channel 60 preferably extends along the entire perimeter of the basement or crawlspace. However, other drainage conduit lengths and configurations may be had depending on the water problems affecting the basement or crawlspace. In addition to the waterproof drying system B including a blower 84, the collection channel 60 may include an interior which entraps water entering into the basement and drains the water via water flow to either a gravity drain or a sump. A plurality of drains may exist in connection with the gravity drain or sump. Typical water proofing systems are well known in the art.

To facilitate in the removal of moisture and water vapor from drainage conduit 68, air is circulated throughout the length of drainage conduit 68 by the waterproof drying system B including the blower 84. By circulating air throughout the drainage conduit, the water vapor is removed, enabling the liquid water to experience a phase shift into becoming water vapor which is then subsequently removed. This facilitates the drying of the waterproofing system. For example, if the temperature of water is 25 degrees Celsius, the liquid water tries to maintain sufficient water vapor in contact with it to maintain a pressure of 25 mm of mercury. When air removes the water vapor away, the liquid water re-establishes the 25 mm of mercury by evaporating more liquid and hence increases the rate of evaporation. By providing moving air throughout the drainage conduit, the water vapor and water standing in the drainage conduit are removed.

The air utilized to circulate through drainage conduit 68 originates outside drainage conduit 68. For example the air circulated through the waterproofing system A can be drawn from the interior of the basement through the channels 22 in the panel 10. With the water and water vapor inside of drainage conduit 68, the humidity of the air inside drainage conduit 68 is generally higher than the air inside the basement. Air is drawn in form outside the panel 10 into the collection channel 60. The blower 84, shown in FIG. 2, pulls air through the collection channel 60 and the vent 88 enables the drawn air and associated water vapor to be drawn away from drainage conduit 68. Preferably, vent 88 vents the drawn air and associated water vapor outside the dwelling. Preferably blower 84 is a fan or vacuum having sufficient drawing strength for drawing air through the entire length of collection channel 60 and through vent 88. The operating capacity of the blower 84 will depend upon the overall size of waterproofing system A. Also, if waterproofing system A includes a plurality of panels 10, blower 84 will also require sufficient operating capacity to ensure that air is drawn through the entire waterproofing system A.

In operation, with the air in the basement being drier than the air in the waterproofing system A, the air in the basement is utilized for transporting water vapor from the interior of the waterproofing system facilitating in rapid drying of the interior of the waterproofing system A. Additionally, air is circulated throughout the dwelling by circulating the air within the basement outside which further reduces any moisture build up within the basement from the presence of water.

Waterproofing system A may also include a humidistat for sensing the amount of moisture in the drainage conduit. The humidistat may be coupled to control device for activating blower 84 when a certain level of water vapor within waterproofing system A is detected. Finally, a timer may be utilized for programming the blower 84.

The combination of providing a graded drainage trough 69 in addition to an air flow for removing any residue moisture from the trough, provides for an effective water removal system which does not leave a damp surface which promotes the growth of mold. In the preferred embodiment, the drainage trough 69 is created by pouring a distinct cement layer on top of the level foundation. This cement drainage trough initially inhibits any further water flow into the basement area as a barrier is created at the interface of the foundation and basement wall. Consequently, the water is forced to rise up and into the trough wherein the concave shape collects the water and the downwardly sloping grade carries the water to a drainage such as a gravity drain.

Accordingly, in operation, an improved waterproofing system may be had. By utilizing preformed panels 10, the system may be installed very quickly and provide for the reduction of condensation collecting on the surface of the waterproofing system. The primary importance of prohibiting the condensation of interior water vapor on the vapor diffusion retarder is that once the waterproofing system is installed, for building code purposes, finishing material such as paneling or drywall will be erected over the panels. Consequently, under prior systems, water vapor from within the basement would pass through the finishing material and condense against the cool uninsulated vapor diffusion retarder. Consequently, the condensation would run down behind the drywall and unbeknownst to the home owner, mold would start growing in the wet environment in combination with the paper of the drywall. Applicant's invention is focused on removing the possibility of condensation from occurring behind the drywall. Alternatively, panel 10 could serve as the interior wall of the basement or crawlspace.

While the various embodiments of this invention have been described in detail with particular reference to exemplary embodiments, those skilled in the art will understand that variations and modifications can be effected within the scope of the invention as defined in the appended claims. Accordingly, the scope of the various embodiments of the present invention should not be limited to the above discussed embodiments, and should only be defined by the following claims and all equivalents.

What is claimed is:

1. A waterproofing system for a dwelling having a wall, a floor, and a foundation, said wall having a first surface for defining an interior of the dwelling and an exterior in communication with graded soil, said waterproofing system comprising:

a waterproofing panel including:

a front vapor diffusion retarder layer that substantially prevents the passage of moisture vapor;

a back vapor diffusion retarder layer that substantially prevents the passage of moisture vapor;

an insulator layer comprising a rigid insulating material and carried between said front layer and said back layer; and an integral collection channel, comprising a top collection portion and a side collection portion, for collecting water entering into the dwelling from the exterior;

one or more drains disposed in line with the collection channel for removing water from the dwelling.

2. The waterproofing system of claim 1 wherein said back vapor diffusion retarder layer has an undulating profile wherein certain portions of the back vapor diffusion retarder layer are offset from the wall.

3. The waterproofing system of claim 1 wherein the top collection portion is disposed at an outward, non-parallel angle to the waterproofing panel; and wherein the side collection portion is disposed substantially parallel to the waterproofing panel.

4. The waterproofing system of claim 1 wherein the one or more drains are disposed in a drainage trough disposed parallel to the wall, above the foundation, and below the top surface of the floor.

5. The waterproofing system of claim 1 wherein said front vapor diffusion retarder layer and said back vapor diffusion retarder layer have a permeance rating less than 1.0.

6. The waterproofing system of claim 1 wherein said collection channel and said front and back vapor diffusion retarder layers are formed from a unitary piece of polymeric material.

7. The waterproofing system of claim 1 wherein a drainage channel for draining water is defined by the collection channel, the dwelling wall and the foundation.

8. The waterproofing system of claim 7 including an air channel in communication with said collection channel enabling a fan to draw air along the collection channel to a vent for communicating moisture vapor to the exterior of the dwelling.

9. The waterproofing system of claim 1 wherein said waterproofing panel extends to a height along the dwelling wall which is above the grade of the exterior soil.

10. The waterproofing system of claim 1 wherein a plurality of waterproofing panels are interconnected along the entire interior of the dwelling.

11. The waterproofing system of claim 10 wherein each waterproofing panel of the respective plurality of waterproofing panels has a flange for overlapping a flange of a respective waterproofing panel and wherein the overlapping flanges are attached to a furring strip for attaching the respective waterproofing panels to the wall.

12. The waterproofing system of claim 4 wherein the drainage trough includes a concave crown portion carried by the foundation.

13. The waterproofing system of claim 1 wherein said waterproofing panel includes a rigid vapor diffusion retarder having an upper portion which carries rigid insulating material and a lower portion defining said collection channel, and said waterproofing panel is a unitary piece which has a sufficient height such that when said waterproofing panel is mounted to a basement wall said waterproofing panel extends upward on the basement wall to a height which is above the soil grade of the dwelling.

14. A waterproofing system for a dwelling having a basement with walls below grade of the exterior; comprising:

a first unitary rigid waterproofing panel including:

a first front vapor diffusion retarder layer that substantially prevents the passage of moisture vapor;

a first back vapor diffusion retarder layer that substantially prevents the passage of moisture vapor and having portions which are offset from a wall when said waterproofing panel is attached to the wall;

a first insulating layer, comprising a rigid insulating material, carried between said first front layer and said first back layer;

a first, integral collection channel, comprising a top collection portion and a side collection portion, established by an extension of at least a portion of said first unitary rigid waterproofing panel;

at least a second unitary rigid waterproofing panel including:

a second front vapor diffusion retarder layer;

a second back vapor diffusion retarder layer having portions which are offset from a wall when said waterproofing panel is attached to the wall;

a second insulating layer carried between said second front portion and said second back portion;

a second, integral collection channel, comprising a top collection portion and a side collection portion, established by an extension of at least a portion of said second unitary rigid waterproofing panel; and one or more drains disposed in line with the first collection channel and the second collection channel for removing water from the basement;

wherein the first and second unitary rigid waterproofing panels overlap to form part of a continuous vapor diffusion retarder which extends around the interior perimeter of said basement.

15. The waterproofing system of claim 14 wherein said insulating layer has an undulating profile.

16. The waterproofing system of claim 14 including a blower in fluid communication with said collection channel for removing moisture from the collection channel.

17. The waterproofing system of claim 16 the top collection portion is disposed at an outward, non-parallel angle to the waterproofing panel; and wherein the side collection portion is disposed substantially parallel to the waterproofing panel.

18. The waterproofing system of claim 17 wherein said "R" value of said insulating layer is at least a "3".

19. The waterproofing system of claim 18 further comprising a drainage trough, disposed below the top surface of the floor and above the foundation, including a concave crown portion carried by a foundation of the dwelling, said concave crown portion defining the bottom portion of a drainage channel in combination with said collection channels of said waterproofing panels.

20. The waterproofing system of claim 14 wherein said waterproofing panels have a general profile, said profile includes a recessed area for receiving a plurality of furring strips for attaching the waterproofing panels to the dwelling wall, said recessed area of sufficient depth such that when said furring strips are received within said recessed area, said furring strips do not extend beyond the general profile of said waterproofing panels.

* * * * *